US010870311B2

(12) United States Patent
Ammon et al.

(10) Patent No.: US 10,870,311 B2
(45) Date of Patent: Dec. 22, 2020

(54) METHOD AND DEVICE FOR TRANSFERRING A DECORATING SEGMENT OF AN EMBOSSING FILM

(71) Applicants: hinderer + muhlich GmbH & Co. KG, Goppingen (DE); LEONHARD KURZ Stiftung & Co. KG, Furth (DE)

(72) Inventors: Gerhard Ammon, Furth (DE); Tibor Mannsfeld, Georgensgmund (DE); Markus Burkhardt, Zirndorf (DE); Thomas Lochner, Ebersbach/Fils (DE)

(73) Assignees: hinderer + muhlich GmbH & Co. KG, Goppingen (DE); LEONHARD KURZ Stiftung & Co. KG, Furth (DE)

( * ) Notice: Subject to any disclaimer, the term of this patent is extended or adjusted under 35 U.S.C. 154(b) by 297 days.

(21) Appl. No.: 15/735,831

(22) PCT Filed: May 31, 2016

(86) PCT No.: PCT/EP2016/062291
§ 371 (c)(1),
(2) Date: Dec. 12, 2017

(87) PCT Pub. No.: WO2016/206926
PCT Pub. Date: Dec. 29, 2016

(65) Prior Publication Data

US 2020/0031160 A1 Jan. 30, 2020

(30) Foreign Application Priority Data

Jun. 23, 2015 (DE) ..... 10 2015 110 077
Sep. 29, 2015 (DE) ..... 10 2015 116 514
Nov. 17, 2015 (DE) ..... 10 2015 119 888

(51) Int. Cl.
*B44B 5/00* (2006.01)
*B44B 5/02* (2006.01)
(Continued)

(52) U.S. Cl.
CPC ..... *B44B 5/028* (2013.01); *B44C 1/1729* (2013.01); *B41F 19/068* (2013.01)

(58) Field of Classification Search
CPC ..... B44C 1/1729; B44B 5/028; B44B 5/008
See application file for complete search history.

(56) References Cited

U.S. PATENT DOCUMENTS 3,584,572 A 6/1971 Apicella
5,517,336 A * 5/1996 Molee ..... B44C 1/1729 264/1.31
(Continued)

FOREIGN PATENT DOCUMENTS

AT 414059 8/2006
CN 101405144 A 4/2009
(Continued)

OTHER PUBLICATIONS

Chinese Office Action for corresponding Chinese Patent Application No. 201680036615.7, pp. 1-17 (dated Jan. 11, 2019).

*Primary Examiner* — Scott W Dodds
(74) *Attorney, Agent, or Firm* — Hoffman & Baron, LLP

(57) ABSTRACT

A method for transferring a decorative section of a stamping foil onto a substrate by means of an embossing die, wherein the stamping foil includes a carrier film and a transfer ply arranged on the carrier film. The method includes:
a) Provision of the stamping foil;
b) Embossing or pressing of at least one compression section spaced apart from the edge of the decorative section, into the transfer ply;
c) Stamping of the decorative section onto the substrate;
d) Detachment of the residual stamping film from the substrate embossed with the decorative section.

5 Claims, 5 Drawing Sheets

(51) Int. Cl.
*B44C 1/17* (2006.01)
*B41F 19/06* (2006.01)

(56) References Cited

U.S. PATENT DOCUMENTS

| | | | |
|---|---|---|---|
| 6,280,823 | B1 | 8/2001 | Preisler et al. |
| 9,375,867 | B2 | 6/2016 | Ito et al. |
| 2009/0239046 | A1 | 9/2009 | Vankov et al. |
| 2014/0113115 | A1 | 4/2014 | Ito et al. |

FOREIGN PATENT DOCUMENTS

| | | | |
|---|---|---|---|
| CN | 103608160 | A | 2/2014 |
| CN | 103879218 | A | 6/2014 |
| DE | 608653 | | 1/1935 |
| DE | 2134168 | | 7/1971 |
| DE | 102012105342 | | 12/2013 |
| EP | 2213475 | A | 1/2010 |
| EP | 2380746 | | 10/2011 |
| FR | 2799685 | | 4/2001 |
| WO | WO2006075053 | | 7/2006 |

* cited by examiner

METHOD AND DEVICE FOR TRANSFERRING A DECORATING SEGMENT OF AN EMBOSSING FILM

This application claims priority based on an International Application filed under the Patent Cooperation Treaty, PCT/EP2016/062291, filed May 31, 2016, which claims priority to DE102015110077.0, filed Jun. 23, 2015, DE102015116514.7, filed Sep. 29, 2015 and DE102015119888.6, filed Nov. 17, 2015.

BACKGROUND OF THE INVENTION

The invention relates to a method and a device for transferring a decorative section of a stamping foil onto a substrate.

During the application of stamping foils which contain in the lacquer package in particular strongly crosslinking lacquer systems, for example UV-crosslinking lacquer systems and/or lacquer systems with a high layer thickness, i.e. with a thickness of the transfer ply without carrier film greater than 5 μm, a clean separating edge can only be produced with great difficulty during stamping. In addition, in these cases the separation of the film composite does not take place at the edge of the application tool, but at an undefined position. Through the strong crosslinking, comparatively long or very long polymer chains are formed in the lacquers, whereby the physical properties of the lacquers are correspondingly influenced. Depending on the hardness of a strongly crosslinked lacquer, for example a comparatively hard and brittle lacquer can break in an undefined way during stamping, wherein lacquer flakes of different size can be formed as unwanted contamination. A comparatively soft and elastic lacquer, for example, may not break or only break incompletely, or tear in an undefined way during stamping with the result that, at worst, no separating edge at all is formed. Normally, during stampings of this kind, stray residues of the transfer ply formed as lacquer package, the aforementioned so-called flakes, are formed, which during further processing of the stamped substrate lead to contamination of the machinery and thus to increased cleaning effort. In extreme cases, production waste can be significantly increased by these flakes.

By "flakes" is meant parts of the transfer ply detached from the carrier film, which have not been applied to the substrate. Without adhering to the substrate, the flakes are attached to the parts of a decorative section applied to the substrate adhering to the substrate and, during further processing, can either remain attached thereto or tear off in an uncontrolled manner and thereby cause corresponding problems in the processing of the stamping foil and/or of the substrate. Flakes can be very small, in particular in the micrometer range, and thus e.g. in the form of dust, but also comparatively large, in particular in the range of several millimeters or even centimeters in at least one direction of extension.

SUMMARY OF THE INVENTION

The object of the present invention is to provide an improved method which combines the advantages of a stable stamping foil with the clean separation of the decorative sections from the carrier film.

According to the invention, this object is achieved with the subject-matter of claim 1. A method for transferring a decorative section of a stamping foil onto a substrate by means of an embossing die is proposed, wherein the stamping foil comprises a carrier film and a transfer ply arranged on the carrier film, wherein it is proposed that the method comprises the following steps:

a) Provision of the stamping foil;

b) Embossing or pressing of at least one compression section spaced apart from the edge of the decorative section, into the transfer ply;

c) Stamping of the decorative section onto the substrate;

d) Detachment of the residual stamping film from the substrate embossed with the decorative section.

The method according to the invention has the advantage that, through the formation, i.e. the mechanical pressing or embossing of the compression section in the transfer ply, a defined breaking edge is formed without damaging the carrier film. In the compression section, the layers of the transfer ply are mechanically loaded, such that a predetermined breaking point can thereby be formed at a defined position, which easily breaks when subjected to bending stress. The bending stress is exerted in particular through the subsequent detachment of the carrier film at a certain detachment angle relative to the substrate from the applied decorative section.

The clean separation between decorative section and residual stamping film which can thus be achieved during the transfer of the transfer ply from the carrier film as decorative section onto the substrate, is advantageous in the case of any kind of application, i.e. stamping or application to the substrate. This includes a non-registered and also a registered application. In the case of a non-registered application, the decorative section is applied or transferred, i.e. stamped, from the carrier ply onto the substrate practically endlessly, without taking into consideration the relative position between substrate and decorative section. In the case of a registered application, the decorative section is applied or transferred to the substrate at a defined relative position, in order e.g. to obtain a previously applied, e.g. printed decoration, matching, i.e. registered relative to, the decorative section. Thus, e.g. complementary partial decorations consisting of a printed decoration and a stamped decoration can be produced, wherein a clean separation of the decorative section between these partial decorations is advantageous, in particular even necessary.

By "register" or "registration" or "register accuracy" is meant a positional accuracy of two or more elements and/or layers, here in particular of the substrate and of the stamping foil and/or of the decorative section, relative to each other. The register accuracy is to vary within a predefined tolerance and to be as low as possible. At the same time, the register accuracy of several elements and/or layers relative to each other is an important feature to increase the process security. The positionally accurate positioning can in particular be effected by means of registration marks or register marks detectable by sensors, preferably optically. These registration marks or register marks can either represent special separate elements or regions or layers or themselves be part of the elements or regions or layers to be positioned.

By "residual stamping film" is meant the part of the stamping foil not comprising the decorative section of the stamping foil, or a partial area of this part.

It can be provided that, in method step b), a pressing pressure is applied, which is greater than the stamping pressure formed in method step c).

The ratio of the pressing pressure to the stamping pressure can lie in a range of 1:1 to 1:10,000.

It can further be provided that the pressing pressure is applied in a linear section or at least piecewise linear section. This section can, for example, be elongated in a straight line, but also jagged or wavy. The section can have an open form, in particular as the named line forms, or alternatively also have a closed contour, for example in the form of a circle, ellipse, triangle or rectangle, in particular in the form of a star. The form of the section determines, at least partially, the form of the decorative section transferred onto the substrate.

Thus, for example, a stamping foil formed as a strip can be processed such that pieces of the likewise strip-shaped transfer ply are applied to the substrate as decorative section and a, for example, linearly applied pressing pressure defines the end-face outer edge of the decorative section applied.

Thus, for example, a stamping foil formed as a surface section can be processed such that partial surface portions thereof, in particular so-called smaller patches, are applied to the substrate as decorative section and a pressing pressure applied, for example, with a closed contour defines the circumferential outer edge of the applied decorative section as a patch.

The width of the linear section can lie in a range of from 0.02 mm to 1 mm, in particular of from 0.02 mm to 0.2 mm.

In an advantageous design it can be provided that the spacing of the at least one compression section from the edge of the decorative section lies in a range of from 0 mm to 2 mm. The extent of the decorative section corresponds to the extent of the stamping surface of the embossing die.

A stamping device for transferring a decorative section of a stamping foil onto a substrate by means of an embossing die with a stamping surface is proposed, wherein the stamping foil comprises a carrier film and a transfer ply arranged on the carrier film, wherein it is proposed that in at least one edge section of the stamping surface on the embossing die, in front of the edge of the stamping surface, a folding element is arranged, the lower end face of which is formed as a pressing surface.

The stamping device according to the invention has the advantage that, through the pressing surface of the folding element, a compression section is formed, i.e. mechanically pressed or embossed, in the transfer ply, without damaging the carrier film. In the compression section, the layers of the transfer ply are mechanically loaded, such that a predetermined breaking point can thereby be formed at a defined position, which easily breaks when subjected to bending stress. The bending stress is exerted in particular through the subsequent detachment of the carrier film from the decorative section applied to the substrate at a certain detachment angle relative to the substrate.

It can be provided that the pressing surface is formed as a linear convexly rounded shape. The convex formation has the advantage that the pressing surface does not act as a cutting edge and thus causes no indentation of the carrier film and thus does not damage or otherwise mechanically weaken the carrier film.

The width of the pressing surface can lie in a range of from 0.02 mm to 1 mm, in particular of from 0.02 mm to 0.2 mm. The width is the effective width of the pressing surface, i.e. the width of the effective cross section.

The folding element can be connected to the embossing die in one piece, or alternatively be present as a separate component which is attached to the embossing die.

It can further be provided that the pressing surface is aligned with the stamping surface.

Alternatively, it can be provided that the pressing surface is arranged with a projection parallel to the stamping surface or closer to the stamping foil than the stamping surface in vertical direction. The pressing surface should not project more than 50% of the thickness of the carrier film, in order to avoid damaging the carrier film with certainty. In particular, projections of in particular 10% to 20% of the thickness of the carrier film are already sufficient to achieve a clean separation in the case of the smallest possible mechanical loading of the carrier film.

Furthermore, it is also possible that the projection of the pressing surface relative to the stamping surface is also greater, in particular is 50% to 1000%, preferably 50% to 700% of the thickness of the carrier film. A clean separation of transfer plies which have a high mechanical stability is supported hereby.

Tests have thus surprisingly shown that such greater projections of the pressing surface relative to the stamping surface are also possible, without damaging the carrier film in such a way that it can no longer perform its function. In tests of this kind, the projection was approximately 50% to approximately 1000%, preferably approximately 50% to approximately 700% of the thickness of the carrier film. In these tests the carrier film was made of PET. The width of the pressing surface was approximately 0.01 mm to approximately 0.10 mm, preferably approximately 0.02 mm to approximately 0.05 mm. In these tests, the spacing between the pressing surface and the stamping surface was approximately 0 mm, i.e. the pressing surface and the stamping surface are arranged directly adjacent, without any spacing in between.

The carrier film can have a thickness of from 10 μm to 50 μm. Tests have shown that the carrier film should not be less than a certain thickness, in particular 10 μm, because the mechanical stressing of the carrier film by the pressing surface could otherwise lead to tearing of the film during further processing thereof.

The carrier film can consist of an individual film layer or also alternatively of a laminate made of different or identical films.

The spacing between the pressing surface and the stamping surface can lie in a range of from 0 mm to 2 mm. This small spacing impairs the appearance of the transferred decorative section as little as possible. In the case that the pressing surface is aligned with the stamping surface, the spacing between the pressing surface and the stamping surface is approximately 0.1 mm to 2 mm. This spacing is advantageous, such that alternating loading acts on the stamping foil through the adjacent arrangement of stamping surface, spacing and pressing surface, and a predetermined breaking point can thereby be formed in the layers of the transfer ply in a particularly advantageous manner. The stamping foil can in particular extend upwards into the spacing, whereas the stamping foil under the stamping surface and the pressing surface is pressed downwards.

In the case that the pressing surface is arranged with a projection relative to the stamping surface in the direction towards the stamping foil, a spacing can be dispensed with entirely, because then, when the embossing die is lowered onto the stamping foil, the pressing surface acts separately on the stamping foil for a certain time and, in the regions adjacent to the pressing surface, the stamping foil can avoid being pressed in, and no separate spacing is necessarily required for this. However, in this case a spacing can optionally also be provided in addition to the projection.

It is also possible to arrange an underlay element below the substrate, i.e. on the side of the substrate facing away from the pressing surface and the stamping surface, at least in the region of the pressing surface acting on the substrate.

This underlay element has in particular a thickness of approximately 0.5 μm to 200 μm, preferably of approximately 0.5 μm to 100 μm and can reinforce the effect of the pressing surface on the substrate, such that the substrate is somewhat more strongly compressed between pressing surface and underlay element. The formation of a predetermined breaking point can be even better promoted thereby.

The underlay element is preferably made of a material with similar properties to those of the substrate, for example of paper or plastic. However, the underlay element can also be made of metal or of metal alloys or of silicone.

The underlay element can be an individual element, or also be composed of several superimposed elements, with the result that an accurate and sensitive adjustment of the total thickness of the underlay element can be carried out by means of these individual elements with a small thickness in each case. Such an individual element can for example be 0.5 μm to 50 μm, in particular 5 μm to 35 μm thick.

The appearance of the transferred decorative section is also determined by the condition of the substrate, in particular the surface roughness thereof. The pressing surface interacts with the substrate as a counterpressure element. The less rough the surface of the substrate is, the more defined this interaction is and the more precisely the separation of the transferred decorative section can take place.

It can be provided that the spacing can be adjusted by means of a spacer element arranged between the folding element and the embossing die. The spacer element can for example be a spacer plate or a spacer disk. It is also possible to stack several spacer elements on top of each other, in order to be able to sensitively adjust the spacing.

Alternatively, it can be provided that the spacing can be adjusted by means of an adjusting device arranged between the folding element and the embossing die. For example, an adjustment screw with a fine thread can be provided as adjusting device.

It can be provided that the pressing surface is formed vertically adjustable. This embodiment can be used in particular in test operation or for adapting to different qualities of the stamping foil.

The folding element can have elongated holes through which fastening screws penetrate, wherein the pressing surface arranged on the folding element is vertically adjustable after loosening of the fastening screws. For depth adjustment, for example, one or more spacer plates can be arranged between a straightening plate and the stamping surface, and then the folding element can be lowered such that the pressing surface lies flush against the straightening plate. The flush positioning can, for example, be checked with the light-gap method. After tightening of the fastening screws, the spacer plate or spacer plates can be removed and the embossing die can be introduced into the stamping station.

Alternatively, it can be provided that the pressing surface is formed vertically adjustable by means of an adjusting device arranged between the folding element and the embossing die.

The adjusting device can be formed as a worm gear. Because of the desired sensitive adjustment in the micrometer range, it is advantageous to provide a differential worm gear, the output path of which is determined by the difference between the thread pitches of the two interacting screws.

It can also be provided that the adjusting device is formed as a cam gear. An eccentric gear can advantageously be provided as cam gear, the eccentricity of which determines the maximum adjustment path.

In a further design, it can be provided that the folding element and the embossing die are formed in one piece. The one-piece design can preferably be provided in order to form a folding element which encloses the entire stamping surface, or in order to provide an embossing die intended for series production.

It can be provided that the spacing between the pressing surface and the stamping surface is formed as a groove. The groove can, for example, be introduced with a high degree of accuracy by laser machining.

BRIEF DESCRIPTION OF THE DRAWINGS

The invention is now explained in more detail with reference to embodiment examples. There are shown in FIG. 1 a first embodiment example of the stamping device in a first operating position in a schematic representation.

DETAILED DESCRIPTION OF THE PREFERRED EMBODIMENTS

Figure 1:
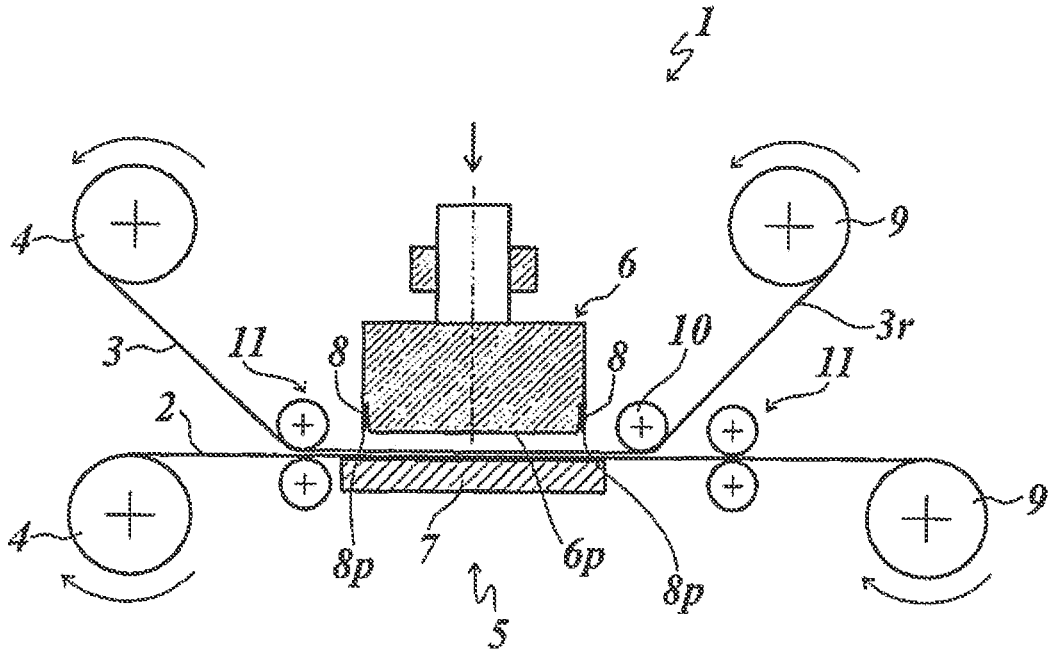
Figure 2:
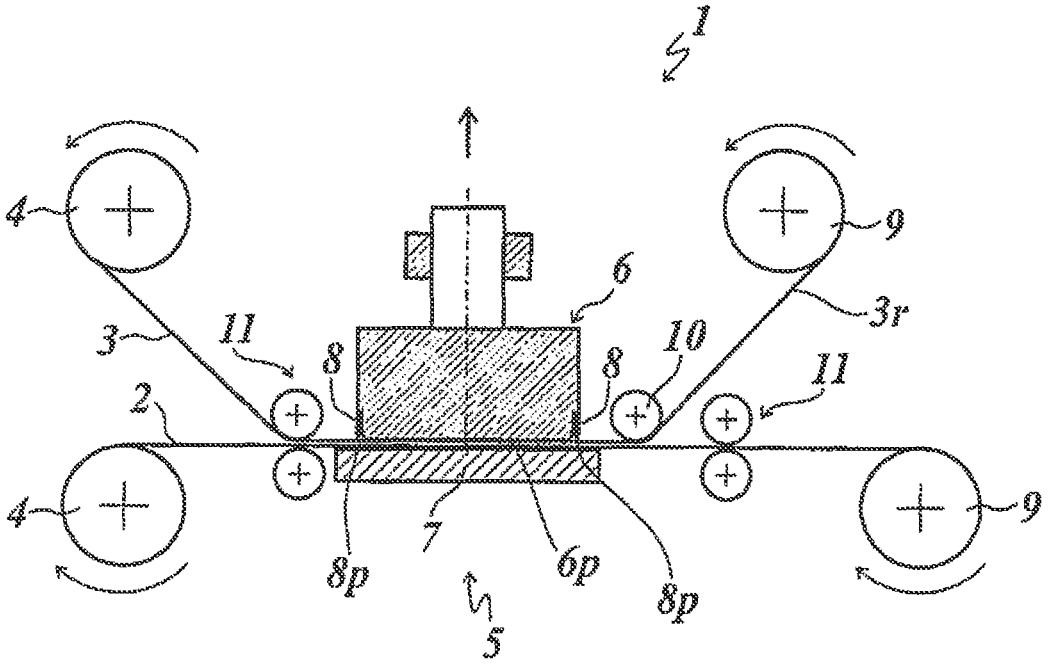
FIG. 2 the stamping device in FIG. 1 in a second operating position.

FIGS. 1 and 2 show a first embodiment example of the stamping device 1 according to the invention in a schematic representation;

In the embodiment shown, the stamping device 1 is formed as a lifting stamping device and for the roll-to-roll method, in which both a substrate 2 to be embossed and a stamping foil 3 are provided on supply rolls 4.

Figure 3:
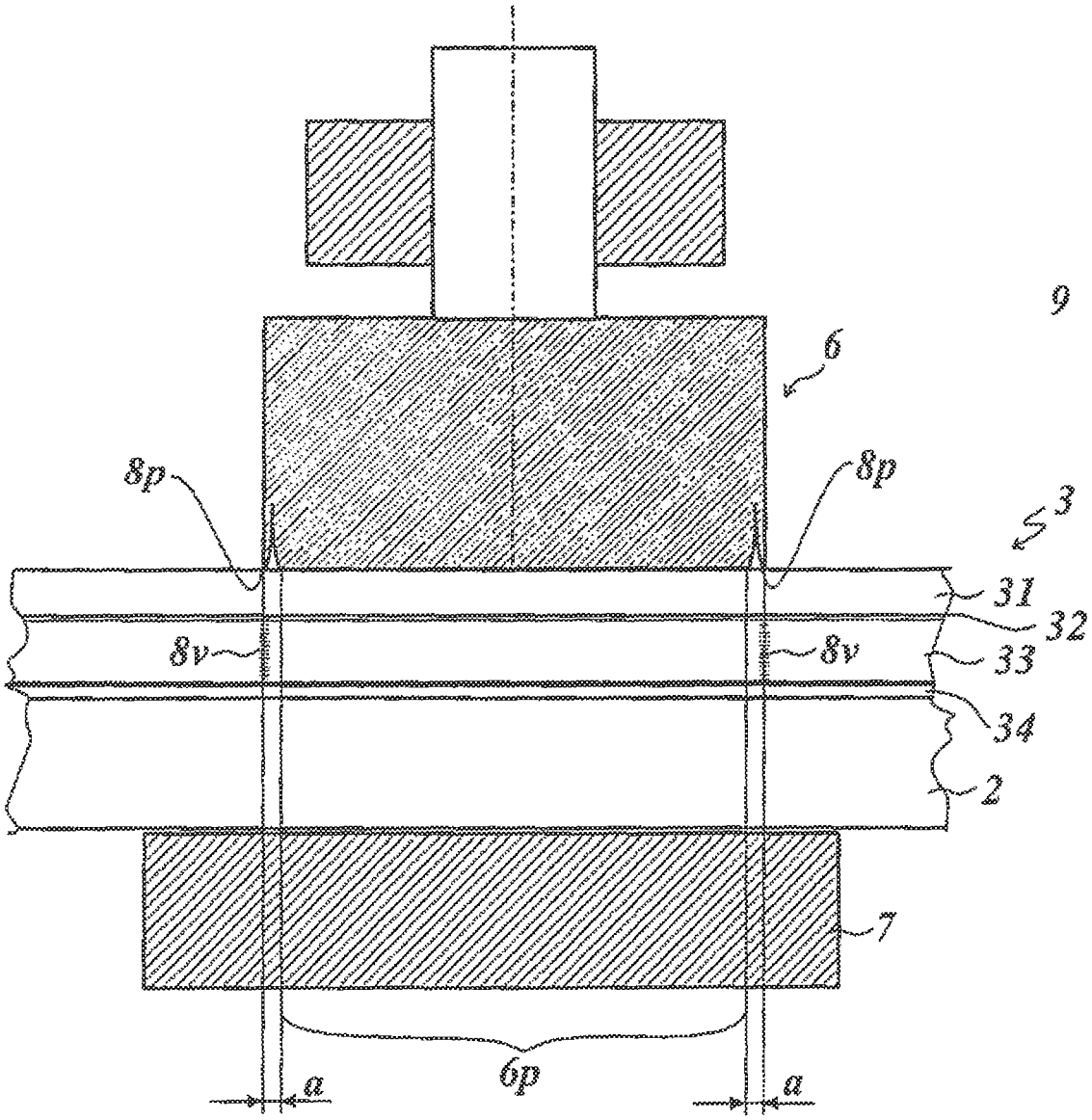
FIG. 3 a detail III in FIG. 2 in an enlarged schematic representation.

The stamping foil 3 comprises a carrier film 31, a detachment layer 32, a transfer ply 33 and an adhesive layer 34 (see FIG. 3). The structure of the stamping foil 3 is described in more detail in FIG. 9 below.

The stamping foil 3 and the substrate 2 are fed to a stamping station 5 with a vertically movable embossing die 6, wherein the substrate 2 lies with its underside on a stamping support 7 in the stamping station 5. The stamping foil 3 lies with its adhesive layer 34 on the top of the substrate 2. Alternatively (not shown), the embossing die can also be formed as a rolling stamping wheel or as a curved embossing die rolling over its curvature.

The embossing die 6 has a heated stamping surface **6*p* on its end face facing the stamping support 7, wherein the dimensions of the stamping surface 6*p* defines the dimensions of a decorative section 3*d* to be transferred from the stamping foil 3 onto the substrate. On the stamping surface 6*p*, at least in one section, a folding element 8 is arranged, with a linear pressing surface 8*p* spaced apart from the edge of the stamping surface 6*p* (see FIG. 3). The pressing surface 8*p* is formed as a convex surface. The spacing a of the pressing surface 8*p* from the edge of the stamping surface 6*p* is approximately 0.1 mm to 0.2 mm. The pressing surface 8*p*** is preferably aligned with the stamping surface 6*p* in a plane parallel to the stamping foil and to the substrate, i.e. it does not project in the direction towards the stamping foil with respect to the stamping surface 6*p*. However, it is also possible that the pressing surface 8*p* projects downwards (in the direction towards the stamping foil) up to a maximum of 50% of the thickness of the carrier film 31 with respect to the stamping surface 6*p*.

In a first operating position, the embossing die 6 is arranged spaced apart from the stamping foil 3 and the substrate 2 (FIG. 1).

In a second operating position (FIG. 2), the embossing die 6 is lowered onto the stamping foil 3 and the substrate 2 and applies the stamping foil 3 to the substrate 2, forming a stamping pressure $p_p$. The heated stamping surface 6*p* of the embossing die 6 activates the adhesive layer 34 of the stamping foil 3 in the region of the stamping surface 6*p* and there connects the stamping foil 3 to the substrate 2 in the region of the decorative section 3*d*. At the same time, the stamping foil 3 is pressed together in the region of the pressing surface 8*p*, forming a pressing pressure $p_k$, wherein material of the stamping foil 3 is displaced to the side of the pressing surface 8*p*. As a result of the pressing pressure $p_k$, the layers of the stamping foil 3 arranged under the carrier film 31 are mechanically loaded in a ribbon-shaped compression section 8*v*. These layers are predominantly lacquer layers.

In the case of a pressing surface 8*p* aligned with the stamping surface 6*p* and spaced apart from the stamping surface 6*p*, the lacquer layers are differently deformed within the smallest space by the mechanical loading acting on the region of the pressing surface 8*p* and the simultaneous unloading in the region of the spacing between stamping surface 6*p* and pressing surface 8*p*, such that in the region of the compression section 8*v*, a predetermined breaking point forms, which breaks under the bending stress caused by the removal of the carrier film.

In the case of a pressing surface 8*p* projecting relative to the stamping surface 6*p*, during the application of the embossing die 6 to the stamping foil 3 and the substrate 2 in the region of the pressing surface 8*p*, a comparatively high pressing pressure $p_k$ is exerted on the stamping foil 3 and the substrate 2, with the result that, due to this strong local mechanical loading, the compression section 8*v* is produced or pressed/embossed in the lacquer layers as a predetermined breaking point, which breaks under the bending stress caused by the removal of the carrier film 31. Seen over time, the pressing surface 8*p* first of all touches the stamping foil 3 and dips comparatively deep into the stamping foil 3 without damaging it. Subsequently, the embossing die 6 then contacts the stamping foil 3 and secures or stamps the decorative section 3*d* on the substrate 2.

After the stamping, the embossing die 6 is raised and returned to the first operating position (FIG. 1). The carrier film 31 is guided downstream via a deflection roller 10 behind the stamping station 5. The carrier film 31 is removed from the transfer ply 33 behind the deflection roller 10, and a residual stamping film 3*r*, comprising the carrier film 31, remaining residues of the transfer ply 33 and of the adhesive layer 34, is fed to a first take-up reel 9. The detachment of the carrier film 31 is supported by the detachment layer 32. The embossed substrate 2 is fed to a second take-up reel 9.

Pairs of transport rollers 11 are provided for the transport of the substrate 2 and of the stamping foil 3.

In the first embodiment example represented in FIGS. 1 to 3, the folding element 8 is formed in one piece with the embossing die 6. A trough-shaped recess is provided to form a spacing a between the pressing surface 8*p* and the edge of the stamping surface 6*p*. In a top view not shown here, the recess shown in cross section in FIGS. 1 to 3 can be formed, for example, elongated in a straight line, but also jagged or wavy. In top view, the recess can have an open form, in particular as the named line forms, or alternatively also have a closed contour, for example in the form of a circle, ellipse, triangle or rectangle, in particular in the form of a star.

Figure 4:
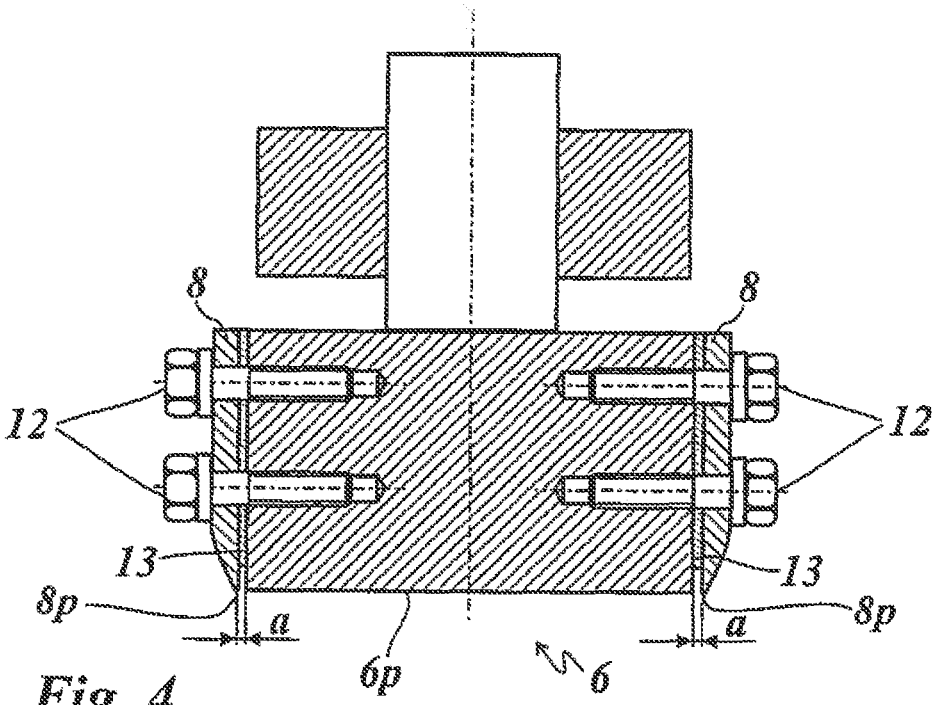
FIG. 4 an embossing die of a second embodiment example of the stamping device in a schematic sectional representation.

In the second embodiment example shown in FIG. 4, the embossing die 6 has a rectangular stamping surface 6*p*, wherein on two opposite sides of the embossing die 6, in each case a folding element 8 is arranged, the pressing surface 8*p* of which runs parallel to the adjacent edge of the stamping surface 6*p*. The pressing surface 8*p* of the folding element 8 is aligned with the stamping surface 6*p* of the embossing die 6.

The folding elements 8 and the embossing die 6 are connected to each other by fastening screws 12, which engage in threaded holes in the embossing die 6.

The spacing a of the pressing edge 8*k* from the edge of the stamping surface 6*p* is determined by the thickness of a spacer plate 13 which is arranged between the folding element 8 and the embossing die 6. It is also possible, instead of a spacer plate, to provide a stack of several thin spacer plates, in order to be able to sensitively adjust the spacing a.

Figure 5:
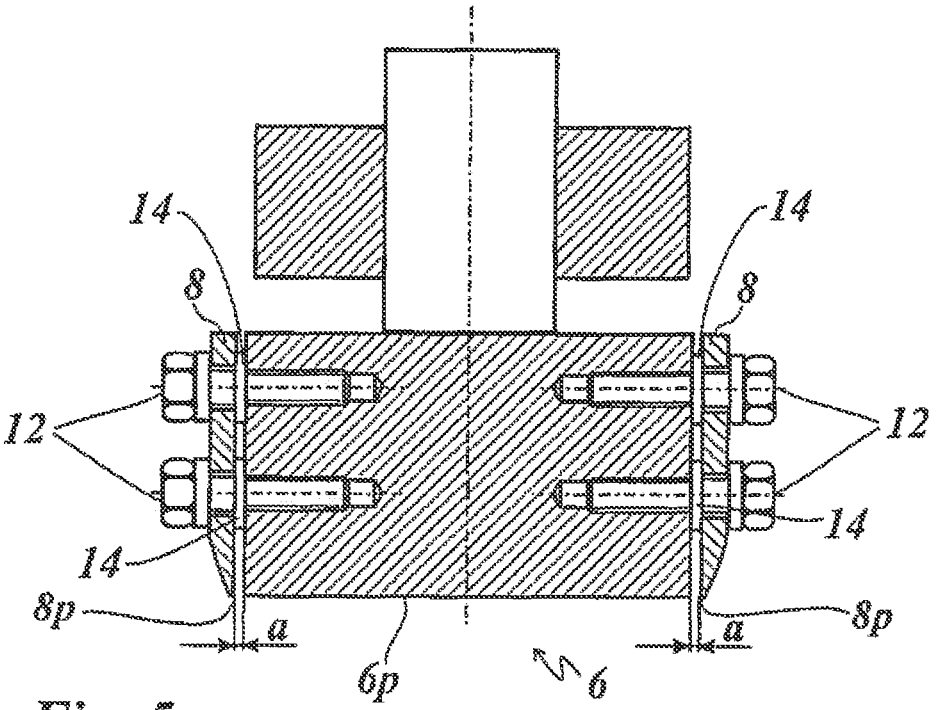
FIG. 5 an embossing die of a third embodiment example of the stamping device in a schematic sectional representation.

The third embodiment example represented in FIG. 5 is designed like that described above, with the difference that in the folding element 8, elongated holes are provided which are penetrated by the fastening screws 12, and that the spacing a of the pressing edge 6*k* from the edge of the stamping surface 6*p* is defined by spacer disks 14 instead of a spacer plate.

The elongated holes allow a depth adjustment of the pressing surface 8*p* of the folding element 8 relative to the stamping surface 6*p*. For the depth adjustment, for example, a spacer plate can be arranged between a straightening plate and the stamping surface 6*p*, and then the folding elements 8 can be lowered such that the pressing surfaces 8*p* lie flush against the straightening plate. The flush positioning can, for example, be checked with the light-gap method. After tightening of the fastening screws 12, the spacer plate can be removed and the embossing die 6 can be introduced into the stamping station 5.

Figure 6:
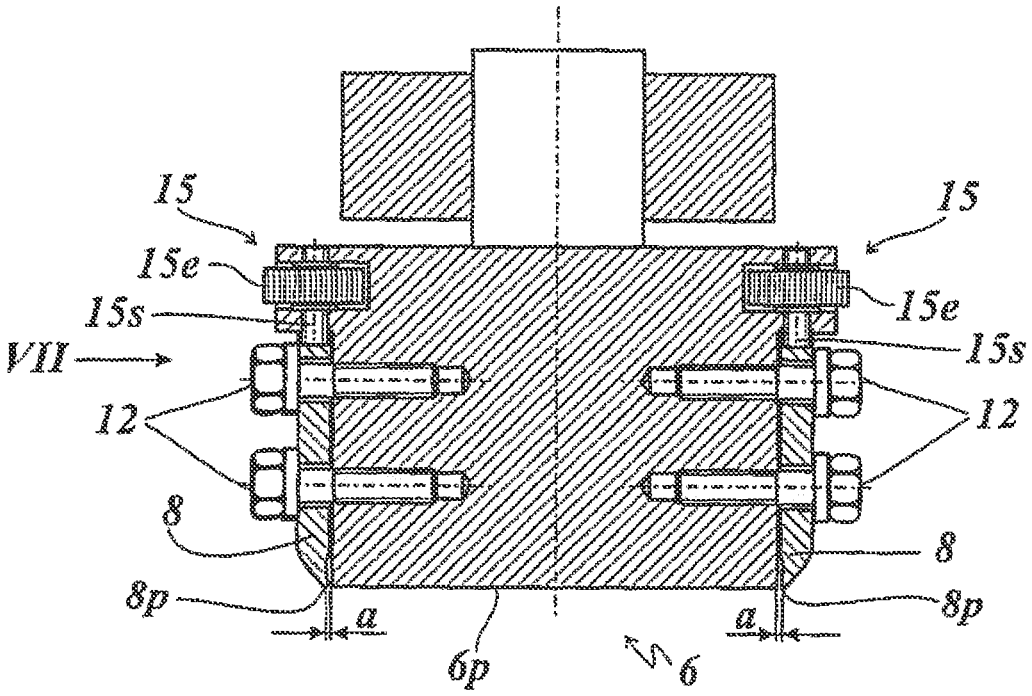
FIG. 6 an embossing die of a fourth embodiment example of the stamping device in a schematic sectional representation.
Figure 7:
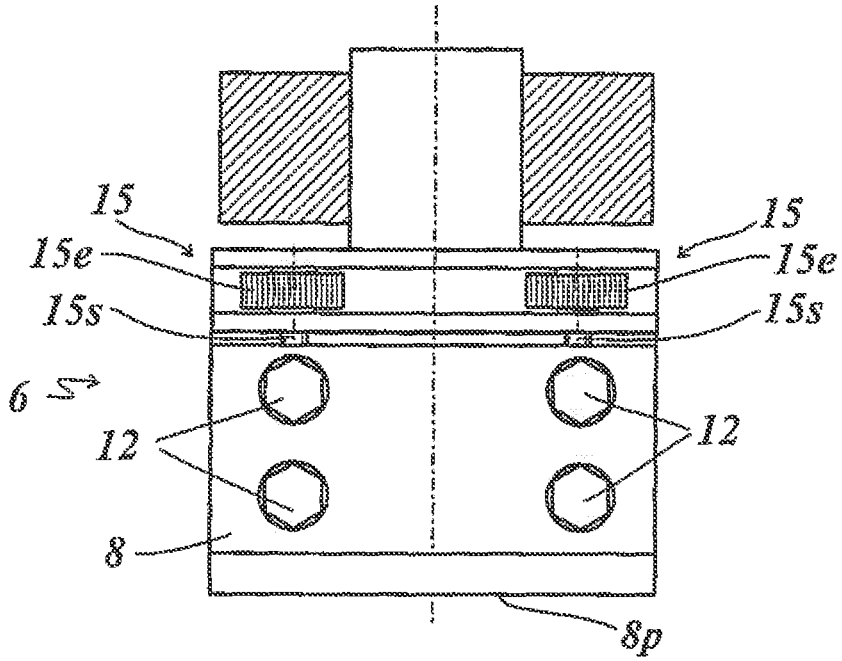
FIG. 7 a side view VII in FIG. 6.

FIGS. 6 and 7 show a fourth embodiment example in which the spacing a of the pressing edge 8*k* from the edge of the stamping surface 6*p* is not formed adjustable due to the formation of the folding element 8 with a recessed pressing surface 8*p*.

As in the embodiment example described in FIG. 5, a depth adjustment of the pressing surface 8*p* of the folding element 8 relative to the stamping surface 6*p* is provided. The depth adjustment is realized by means of a worm gear 15 which comprises an adjustment screw 15*s* and an adjustment wheel 15*e*. The adjustment screw 15*s* is formed with a fine thread. The adjustment screw 15*s* is rigidly connected to the upper end section of the folding element 8 and engages in a threaded hole of the adjustment wheel 15*e*. The adjustment wheel 15*e* can have a scale, in order to be able to reproduce the adjustment path of the worm gear 15.

The embossing die 6 has a projecting upper end section in which the worm gear 15 is arranged. The adjustment screw 15*s* is mounted in a through-hole vertically penetrating the upper end section. The adjustment wheel 15*e* is arranged in a horizontal slot-shaped receiver of the upper end section of the embossing die 6 and is thus not axially displaceable.

As described in FIG. 5, fastening screws 12 which penetrate the elongated holes of the folding element 8 are provided for fixing the folding element 8 to the embossing die 6.

Figure 8:
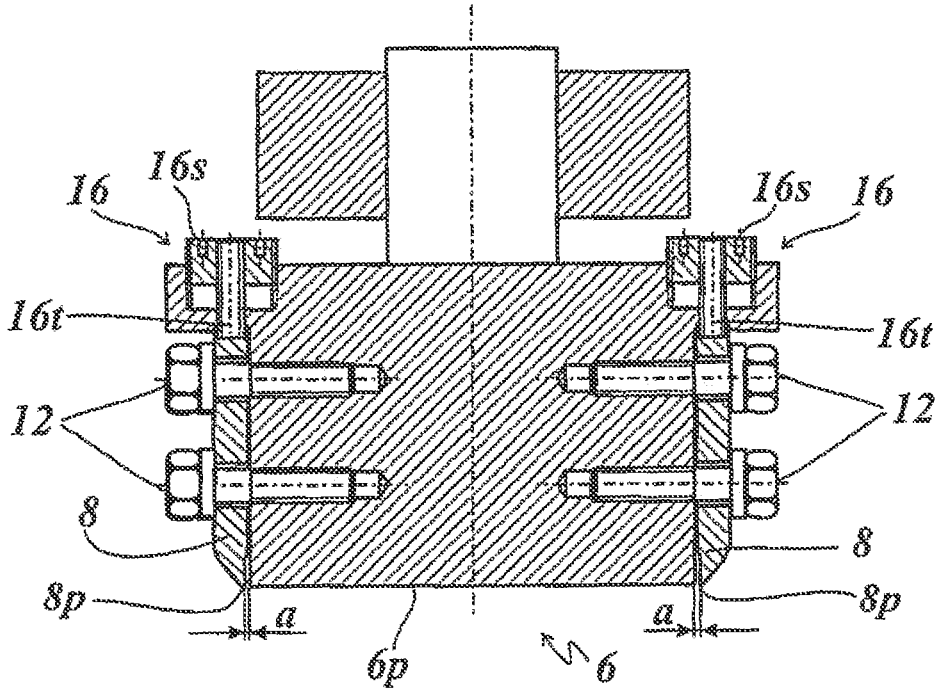
FIG. 8 an embossing die of a fifth embodiment example of the stamping device in a schematic sectional representation.

The fifth embodiment example represented in FIG. 8 differs from the embodiment example represented in FIG. 7 in that, for the depth adjustment of the pressing surface 8*p*, a double worm gear 16 is provided, which comprises a first adjustment screw 16*s* and a second adjustment screw 26*t* which are formed with different thread pitches, wherein the first adjustment screw 16*s* is adjustable from outside and engages in a perpendicular threaded hole of a projecting upper end section of the embossing die 6, and the second adjustment screw 16*t* engages in a central threaded hole of the first adjustment screw 16*s* and is rigidly connected to the upper end section of the folding element 8. The smaller the difference between the thread pitches of the two adjustment screws 16*s* and 16*t*, the more sensitive the adjustment of the vertical adjustment path of the pressing surface 8*p*.

Figure 9:
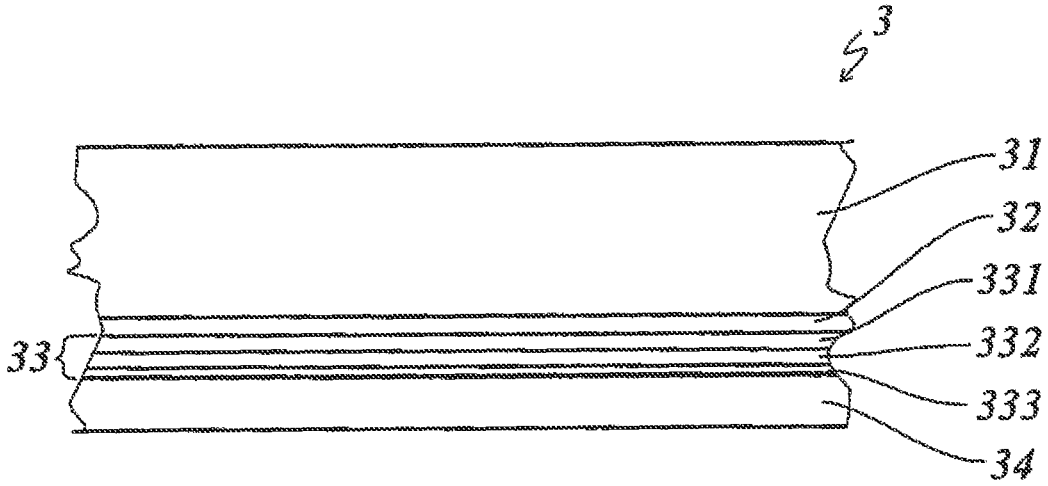
FIG. 9 an embodiment example for the structure of a stamping foil in a schematic representation.

FIG. 9 shows the layered structure of a stamping foil 3 used in the stamping device 1 according to the invention, wherein the schematic representation approximately reproduces the thickness ratios of the stamping foil 3.

In this embodiment example the carrier film 31 is formed as a PET film with a layer thickness of 19 μm.

The detachment layer arranged between the carrier film 31 and the transfer ply 33 is a lacquer layer with a thickness of from 0.5 μm to 1 μm.

The transfer ply 33 has the following layers which are in each case formed by a lacquer

- a protective layer 331 made of an acrylate crosslinked with UV radiation, with a thickness of from 1 μm to 10 μm,
- a decorative layer 332 made of an acrylate, of PVC or a mixture thereof with dyes and/or color pigments, with a thickness of from 0.5 μm to 50 μm, in particular 0.5 μm to 30 μm,
- a stabilization layer 333 made of an acrylate crosslinked with UV radiation, with a thickness of from 1 μm to 10 μm.

The thickness of the transfer ply 33 is thus between 5.5 μm and 70 μm.

In the embodiment examples described above, the adhesive layer 34 is a hot adhesive layer which is heat-activatable. The adhesive layer 34 is made of PVC with a layer thickness of from 1 μm to 10 μm. However, it is also possible to use a cold adhesive layer, which can be activated by means of high-energy radiation.

During testing of the proposed stamping device 1, the following parameters proved useful.

The stamping temperature lies in a range of from 80° C. to 250° C., preferably in a range from 100° C. to 200° C., depending on the stamping station 5 and the substrate 2.

The stamping pressure lies in a range of from 1 kN/cm$^2$ to from 10 kN/cm$^2$.

The stamping time lies in a range of from 1 ms to 1000 ms, in particular in a range of from 1 ms and 500 ms.

LIST OF REFERENCE NUMBERS

1 stamping device
2 substrate
3 stamping foil
3*d* decorative section
3*r* residual stamping film
4 supply roll
5 stamping station
6 embossing die
6*p* stamping surface
7 stamping support
8 folding element
8*k* pressing edge
8*p* pressing surface
8*v* compression section
9 first and second take-up reel
10 deflection roller
11 pair of transport rollers
12 fastening screw
13 spacer plate
14 spacer disk
15 worm gear
15*e* adjustment wheel
15*s* adjustment screw
16 double worm gear
16*s* first adjustment screw
16*t* second adjustment screw
31 carrier film
32 detachment layer
33 transfer ply
34 adhesive layer
331 protective layer
332 decorative layer
333 stabilization layer
a spacing of the pressing edge 8*k* from the edge of the stamping surface 6*p*
$p_p$ stamping pressure
$p_k$ pressing pressure

The invention claimed is:

1. A method for transferring a decorative section of a stamping foil onto a substrate by means of an embossing die, wherein the stamping foil comprises a carrier film and a transfer ply arranged on the carrier film, the method comprising:

a) Provision of the stamping foil;

b) Forming a predetermined mechanically loaded breaking point at a defined position in the transfer ply of the stamping foil by embossing or pressing of at least one compression section, spaced apart from an edge of the decorative section, into the transfer ply, the predefined mechanically loaded breaking point facilitating breaking of the transfer ply when subjected to bending stress;

c) Stamping of the decorative section from the stamping foil onto the substrate, wherein the decorative section is embossed and transferred to the substrate such that remaining portions of the stamping foil not transferred form a residual stamping film;

d) Detachment of the residual stamping film from the substrate embossed with the decorative section by exerting a bending stress at the predefined mechanically loaded breaking point, wherein, during said embossing or pressing, a pressing pressure $p_k$ is applied, which is greater than a stamping pressure $p_p$ applied during said stamping.

2. The method according to claim 1, wherein the ratio of the pressing pressure $p_k$ to the stamping pressure $p_p$ lies in a range of over 1:1 to 10,000:1.

3. The method according to claim 1, wherein the pressing pressure $p_k$ is applied in a linear section or at least piecewise linear section, wherein the linear or at least piecewise linear section is straight, jagged or wavy or has a closed contour, in the form of a circle, ellipse, triangle, rectangle or star.

4. The method according to claim 3, wherein the width of the linear section lies in a range of from 0.02 mm to 0.2 mm.

5. The method according to claim 1, wherein the spacing of the at least one compression section from the edge of the decorative section lies in a range of from 0 mm to 2 mm.

* * * * *